United States Patent [19]

Sauer et al.

[11] 4,311,976

[45] Jan. 19, 1982

[54] POLARIZED REED RELAY

[75] Inventors: Hans Sauer, Fichtenstrasse 5, Deisenhofen, Fed. Rep. of Germany, D-8024; Humihiro Kasano, Shijonawate; Yoichi Isobe, Tsu, both of Japan

[73] Assignees: Matsushita Electric Works, Ltd., Osaka, Japan; Hans Sauer, Deisenhofen, Fed. Rep. of Germany

[21] Appl. No.: 135,532

[22] Filed: Mar. 31, 1980

[30] Foreign Application Priority Data

Mar. 30, 1979 [JP] Japan ..... 54-38816
Jun. 15, 1979 [JP] Japan ..... 54-75787

[51] Int. Cl.[3] ..... H01H 51/22
[52] U.S. Cl. ..... 335/78; 335/179
[58] Field of Search ..... 335/78, 79, 179, 229, 335/157

[56] References Cited

U.S. PATENT DOCUMENTS 4,091,346 5/1978 Nishimura et al. ..... 335/78
4,225,835 9/1980 Vŕšnák et al. ..... 335/78

FOREIGN PATENT DOCUMENTS 1243271 7/1970 Fed. Rep. of Germany .
1909940 8/1972 Fed. Rep. of Germany .
2459039 11/1977 Fed. Rep. of Germany .
2462277 7/1978 Fed. Rep. of Germany .
2747607 4/1979 Fed. Rep. of Germany .

*Primary Examiner*—Harold Broome
*Attorney, Agent, or Firm*—Schwartz, Jeffery, Schwaab, Mack, Blumenthal & Koch

[57] ABSTRACT

A polarized reed relay comprises a bobbin with a coil wound thereon, two ferromagnetic contact reeds extending through an interior passage of the bobbin, a permanent magnet, and two pairs of pole shoes. Each contact reed is fixed at one end and has its other, free end cooperating with fixed contact portions formed by a pair of pole shoes. A relay is thus provided in which two double-throw contact systems electrically insulated from each other may be operated absolutely synchronously.

17 Claims, 12 Drawing Figures

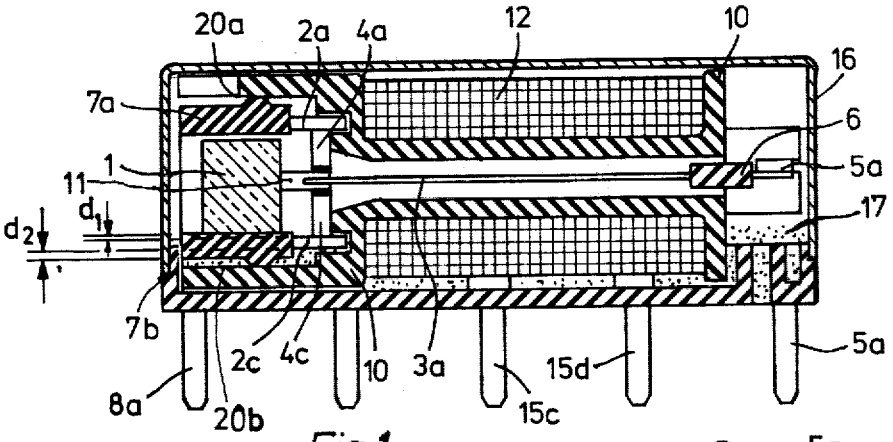
Fig.1
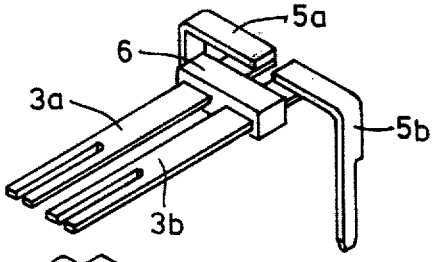
Fig.2a
Fig.2c
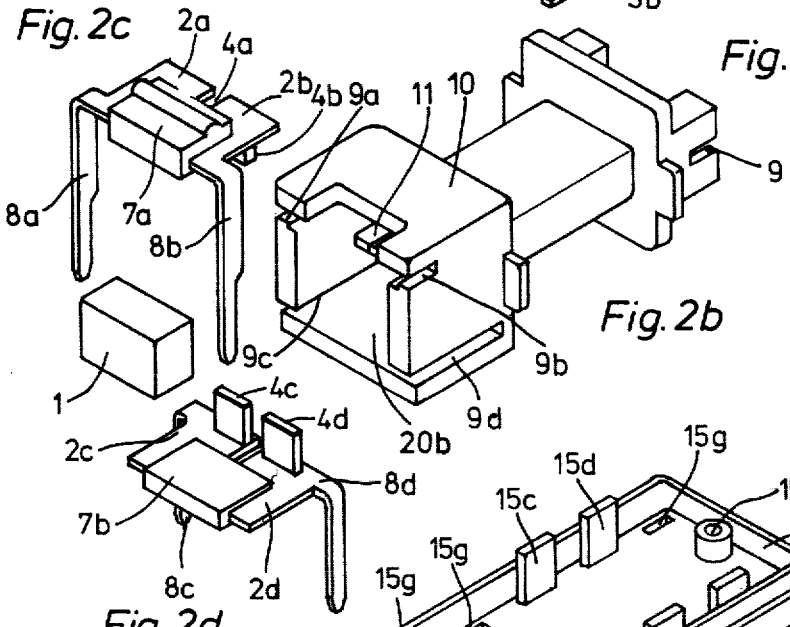
Fig.2b
Fig.2d
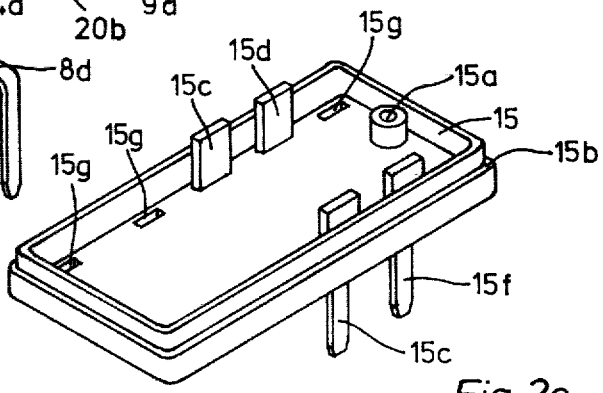
Fig.2e

POLARIZED REED RELAY

BACKGROUND OF THE INVENTION

German Pat. Nos. 1 243 271, 1 909 940, 2 459 039, and 2 462 277 disclose polarized reed relays having one ferromagnetic contact reed extending through the interior of a bobbin along the axis thereof and free contacts positioned in the bobbin for cooperation with the contact reed, the fixed contacts acting as pole shoes of a permanent magnet. These known relays may be provided with only one switch-over contact system.

Other reed relays are known which have two or more contact systems. These other known relays, however, are completely different in structure and of inferior efficiency.

It is an object of the present invention to devise a relay of the same general structure as the relays known from the above-mentioned German patent specifications in such a manner that at least two double-throw contact systems may be synchronously actuated by a permanent magnet arrangement of the type known per se as successful.

SUMMARY OF THE INVENTION

The polarized reed relay according to the present invention comprises a bobbin having at least one coil wound thereon, two ferromagnetic contact reeds extending substantially along the coil axis through an interior passage provided in the bobbin, each reed being fixed at one of its ends to the bobbin, at least one permanent magnet, and two pairs of pole shoes positioned in the bobbin, each pole shoe having a first portion disposed in proximity of a pole of the magnet and a second portion forming a fixed contact, each pair of fixed contacts cooperating with the free end of one of the reeds to form a double-throw contact system.

In a preferred embodiment of the invention, the two contact reeds extend parallel of each other and are connected to terminals which also extend parallel of each other, so that they may be engaged by a common adjusting means for adjusting the pick-up and drop-out values of each reed. The advantage of the known general relay structure referred to above which resides in the possibility of adjusting the relay in the same magnetic field to which it is exposed during actual operation, is thus maintained for both contact reeds.

It is often a requirement that both the closure and the opening of a plurality of contact pairs occur synchronously even with slowly rising or falling excitation voltages. To achieve such a synchronous contact closure and opening in the relay of the present invention, the reeds are ganged by one or two insulating plates connected to the reeds by rivets or ultrasonic welding, or by being embedded in a common piece of casting material and thus positioned parallel to each other. In this case, the fixed contacts which are electrically insulated from each other must be positioned in the same plane and—if possible—combined to form a unit.

Moreover, since the pole shoes which carry contact currents must be well insulated with respect to each other, they are embedded in plastics material which is in the thickness of a film or foil on the side of the pole shoe facing the magnet and has a thickness or profile corresponding to the mechanical requirements on the other side.

The pairs of pole shoes and the contact reeds thus connected to form units may be connected to the bobbin in various ways. In case the reeds or fixed contacts are disposed parallel to each other, it is preferred to position them positively in corresponding slots provided in the bobbin. The spacing between opposite fixed contacts may be defined by intermediate layers integrally formed in the bobbin or—where the bobbin is made of two parts—by a plate of predetermined thickness interposed between the two parts. Such spacers eliminate tolerances and simplify the adjustment.

Another possibility of providing the relay with two double-throw contact systems is achieved by disposing the permanent magnet system with its pole shoes and fixed contacts in the center of the relay and positioning the contact reeds mirror-wise on both sides of the permanent magnet system, each reed being fixed to a terminal provided at an end of the bobbin and being adjustable in a known manner.

In this arrangement, two coils are provided which may be electrically connected to each other or separate from each other in accordance with the requirements of the specific application. In case of two separate independent coils, each double-throw contact system may be actuated independently of the other. It is furthermore possible to provide one of the two switch-over contact systems with a monostable behaviour and the other one with a bistable behaviour by correspondingly setting the spring bias. Furthermore, separate terminals of two independent coils may be interconnected to a common coil externally, e.g. by an accordingly devised circuit board into which the relay is inserted.

In another preferred embodiment of the invention, a capacitor connected in series with the coil and an integrated circuit including a trigger stage as disclosed in German Offenlegungschrift No. 2 747 607 may be provided for synchronously actuating two contact reeds which are not ganged—even in case of gradually increasing or decreasing excitation voltages. In this case, the contact reeds are set for bistable behaviour. The trigger stage switches only at a predetermined voltage sufficient for the two double-throw contact systems to respond abruptly. The capacitor is thereby charged and blocks the flow of current through the coil. A relay set for monostable operation would immediately drop out, whereas the bistable relay maintains its condition until the supply voltage is interrupted and the capacitor discharges through the coil and the trigger stage of the integrated circuit, thereby resetting the relay contacts to their initial position again in an abrupt manner. In this type of actuation, a bistably adjusted relay is provided with a monostable behaviour in which synchronous actuation of both contact systems is ensured. Moreover, actuation energy is required only during the very short switch-on period of about 1 ms.

BRIEF DESCRIPTION OF THE DRAWINGS

FIG. 1 is a longitudinal section taken along the center axis of a finished relay having two parallel contact reeds.

FIGS. *2a* to *2e* together represent a perspective exploded view of the relay shown in FIG. 1 with the relay cap omitted.

Figure 3:
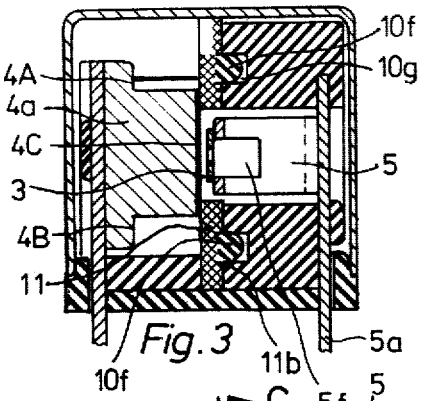
Figure 4:
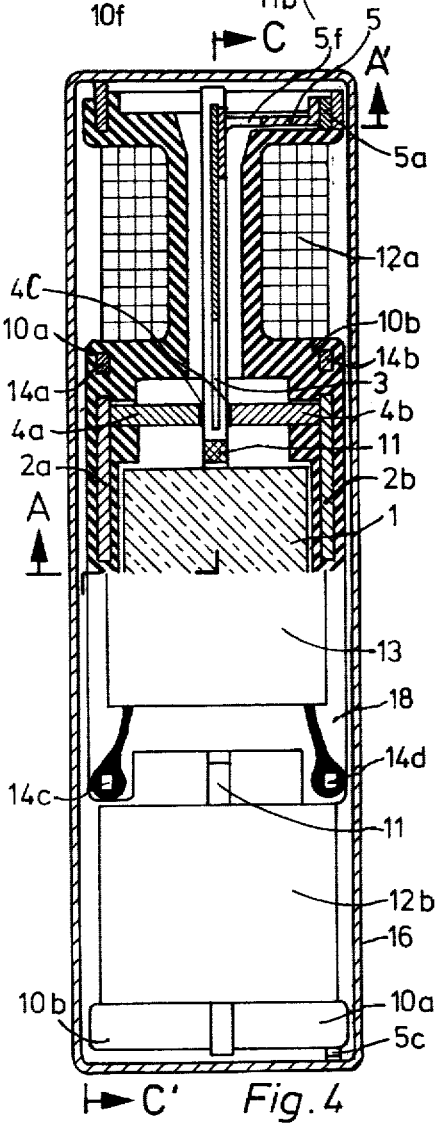
Figure 5:
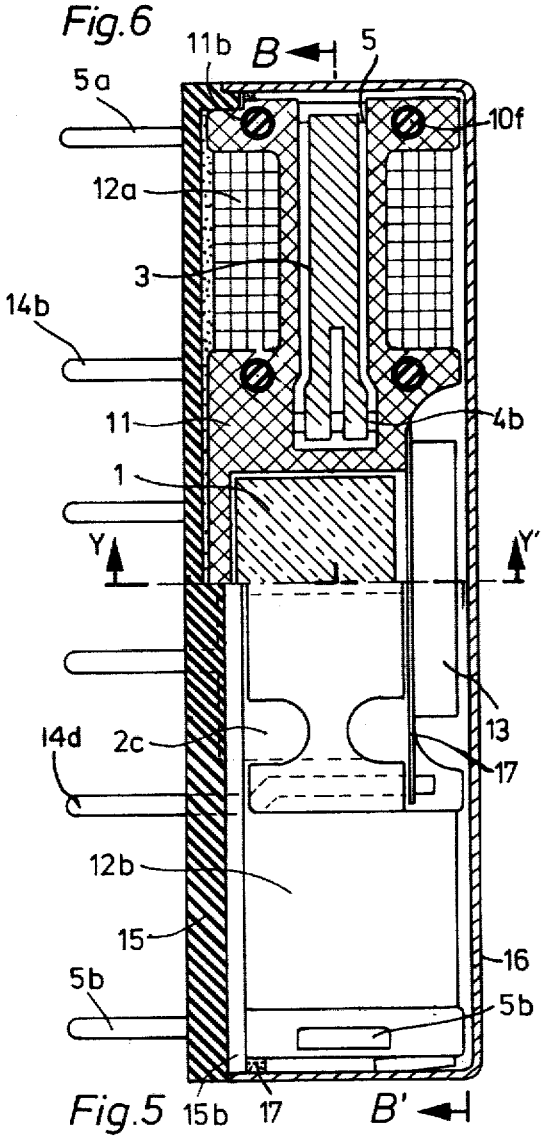

FIGS. 3, 4 and 5 illustrate a relay having two coils disposed mirror-wise with respect to an axis Y—Y', wherein FIG. 3 is a cross-section taken along the line A—A' in FIG. 4, FIG. 4 is a longitudinal section taken along the line B—B' in FIG. 5, and FIG. 5 is a longitudinal section taken along the line C—C' in FIG. 4.

Figure 6:
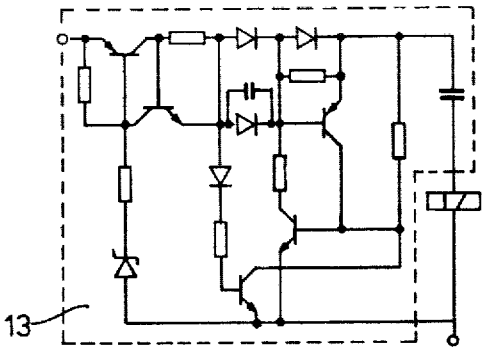

FIG. 6 is a schematic diagram of a circuit for synchronously actuating the two reeds of the relay shown in FIGS. 1 and 2 or of the one shown in FIGS. 3 to 5.

Figure 7:
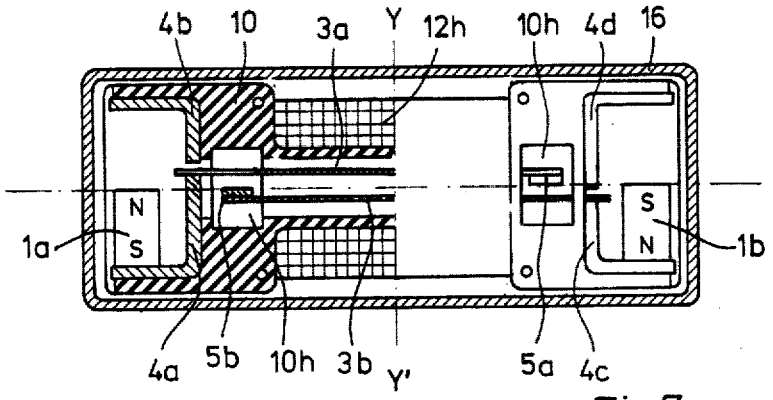

FIG. 7 is a longitudinal section taken along the center axis of a relay having two magnets disposed mirror-wise at the ends of a bobbin and polarized oppositely, wherein the two contact reeds disposed in the protective tube formed by the bobbin face each other with their wide sides and have their free ends extend in opposite directions.

Figure 8:
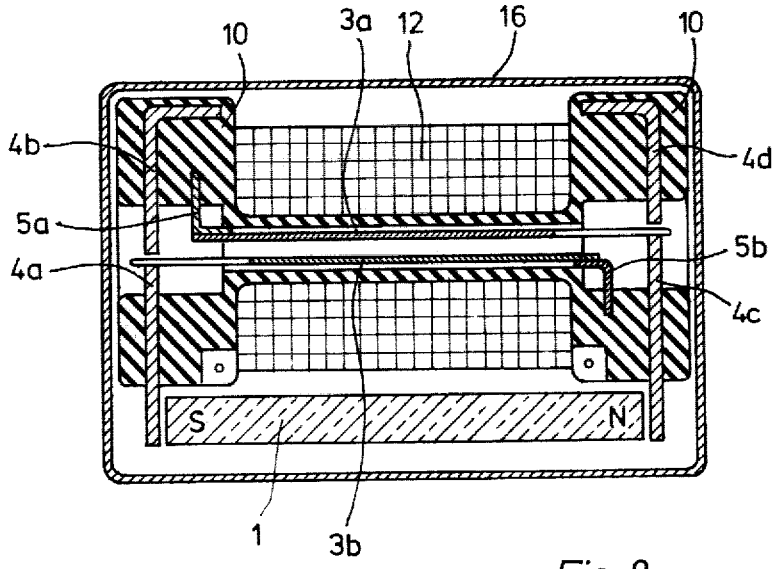

FIG. 8 is a longitudinal section taken along the center axis of a relay having one magnet the two pole shoes of which are formed as fixed contacts and associated each with one contact reed.

DETAILED DESCRIPTION OF PREFERRED EMBODIMENTS

In the embodiment shown in FIGS. 1 and 2, a permanent magnet 1 which preferably consists of BaOFe is disposed between four pole shoes 2a, 2b, 2c and 2d which are electrically insulated with respect to each other. As shown in FIGS. 2c and 2d, each pair of pole shoes 2a, 2b and 2c, 2d is partly embedded in a piece 7a, 7b of insulating material formed by injection molding such that the side facing the magnet is covered by a relatively thin layer of a thickness d1, whereas the layer on the other side has a substantially greater thickness d2. The thickness d1 should be small to achieve optimum coupling between the magnet and the pole shoe, but it should not be zero as it serves not only as an insulation but also as a magnetic air gap. Whenever a magnet directly abuts a pole shoe without any air gap, optimum coupling is theoretically achieved, but in practice the coupling varies due to the unevenness of the magnet surface and other factors. As a result, the adjustment of the relay becomes difficult and in most cases cannot be performed automatically. For this reason, an air gap in combination with a correspondingly stronger permanent magnet is preferred to a system without an air gap.

Moreover, the embedding provides the advantage that a semicylindrical profile (compare FIG. 2c) may be intergrally formed which helps compensating tolerances of the pole shoes and the fixed contacts 4a, 4b, 4c and 4d provided on the pole shoes with respect to guiding slots 9a, 9b, 9c, 9d provided in the bobbin 10 and the abutting surfaces 20a, 20b thereof. Accordingly, only tolerances in the thickness of the contact reeds 3a, 3b and in that of a spacer 11 formed in the bobbin 10 for supporting the ends of the fixed contacts remain as tolerances influencing the contact gap. Both of these tolerances can be maintained below 0.01 mm.

The fixed contacts which are shown in FIG. 2d (numbered 4c, 4d) as individual pieces mounted on the pole shoes 2c, 2d, could be replaced by correspondingly bent sections of the pole shoes proper. It is desired, however, to expose the fixed contacts to a different surface treatment (also for providing the requiring contact coatings) than is necessary for the pole shoes and their terminals 8a, 8b, 8c, 8d.

Providing the fixed contacts which consists of ferromagnetic material with shoulders (as shown in FIG. 3 at 4A, 4B) for the purpose of spot welding to the pole shoes ensures that the coating 4C of contact material is maintained unaffected. The two contact reeds 3a, 3b, extend parallel to each other in one plane and are partly embedded in a piece 6 of plastics material for being guided in parallel fashion. The piece 6 may be applied by ultrasonic welding of two plastics sheets or by injection molding. In the latter case, the terminals 5a, 5b may also be embedded in plastics material upon spot welding to the contact reeds 3a, 3b to increase strength of the connection which is exposed to stresses particularly during the adjustment. This portion connected to form a unit and shown in FIG. 2a is positioned in the slots 9 of the bobbin 10.

The thus assembled relay structure is inserted in the base 15 shown in FIG. 2e with its terminals extending through the holes 15g. After the magnet 1 has been inserted between the two pairs of pole shoes (FIGS. 2c and 2d) positioned in the bobbin 10 and after the ends of the coil wire have been electrically connected to the coil terminals 15c, 15d and 15e, 15f provided in the base 15, the relay may be adjusted by acting on the location at which the contact reeds 3a, 3b are connected to the reed terminals 5a, 5b. During the adjustment, it is practical to use a ferromagnetic cap which differs from the final cap 16 only by an opening which provides access to the adjustment location. The base 15 has a shoulder 15b for receiving an edge of the cap 16, and one or two openings 15a for filling the relay with a protective gas and for introducing a casting material 17.

The relay in the embodiment of FIGS. 3 to 5 is symmetrical with respect to its axis Y—Y' and comprises two identical bobbin halves 10a, 10b in which the pole shoes 2a, 2b, the coil terminals 14a, 14b, 14c, 14d, the reed terminals 5a, 5b and a grounding terminal 5c are embedded. All these terminals are preferably punched from a ferromagnetic strip from which they are separated upon the embedding by a further punching step.

Ferromagnetic flux conducting portions which form the fixed contacts 4a, 4b are spot-welded to the pole shoes 2a, 2b, preferably at the shoulders 4a, 4b. The end faces of these portions are coated with contact material 4C and serve as the fixed contacts for cooperation with the free end of the contact reed 3 which is also coated with contact material. The other end of the contact reed 3 is spot-welded to a connecting bridge 5 and reed terminal 5a. A window 5f is provided in the connecting bridge 5 to permit access for the adjustment of the contact reed 3.

The identical bobbin halves 10, 10b are provided with fitting pins 10f and mirror-wise located fitting poles 10g which in the assembled condition fit into each other. An insulating plate is disposed between the bobbin halves which acts as a spacer 11 to keep the two fixed contacts 4a, 4b at an exact spacing by virtue of the outer ends of the fixed contacts abutting this spacer 11, thereby also positioning the magnet 1. The positioning of the spacer 11 is ensured by holes 11b through which fitting pins 10f extend.

The embodiment of FIGS. 3 to 6 has the following specific features:

(1) Due to the relatively large distance between the two contact reeds 3 which face each other with their free ends, and due to the mutual shielding of the reeds by the permanent magnet 1, the capacity between the contact reeds is extremely small so that this arrangement is suited for switching high frequency loads.

(2) The two double-throw contact systems may be independently actuated through the coil terminals 14*a*, 14*b* and 14*c*, and 14*d*, respectively.

(3) Since the two contact springs 3 are independently adjusted, one of them may be provided with a monostable behaviour and the other one with a bistable behaviour.

(4) The coil terminals may be interconnected externally or internally by means of a printed circuit board 18.

(5) The circuit board 18 may be equipped with a capacitor and the electronic circuit 13 shown in FIG. 6 and it may be connected as described above in order to achieve a synchronous actuation of both contact reeds and, at the same time, to save excitation energy.

A hermetic sealing of the relay according to the present embodiment, just as in the embodiment described in connection with FIGS. 1 and 2, is achieved by means of the ferromagnetic cap 16, the base 15 and the casting material 17.

Another embodiment of the invention is shown in FIG. 7 one half of which shows a longitudinal section taken along the center axis and the other half of which shows a plan view of the internal relay structure. This relay has one permanent magnet 1*a*, 1*b* at each end of the bobbin 10, each magnet being coupled with opposite polarity to a pole shoe 4*a*, 4*c* formed as a fixed contact. In the non-actuated condition of the relay, these fixed contacts form normally closed contact pairs with a corresponding contact reed 3*a*, 3*b*. In the present embodiment, a synchronous actuation of the two contact reeds 3*a*, 3*b* by excitation of the relay can be realized with a considerably higher accuracy than is achieved for instance with the magnetic arrangement in the embodiment described above in connection with FIGS. 1 and 2. In the embodiment of FIG. 7, as soon as either contact reed opens due to a change of the electromagnetic field in the associated magnetic circuit, this opening accelerates the opening of the other magnetic circuit, thus of the other contact reed, because the entire permanent magnet circuit is practically a series connection of these two magnetic circuits. The relay of this embodiment is also space saving, because the two contact reeds 3*a*, 3*b* extend parallel to each other through the interior space of the bobbin 10 and face each other with their wide surfaces not seen in FIG. 7. Also in this embodiment, two identical bobbin halves will be provided which are fitted together to form one bobbin after the contact reeds have been connected to the reed terminals 5*a*, 5*b* and before the coil 12 has been applied to the bobbin. For adjusting the contact reeds 3*a*, 3*b* at their connection to the reed terminals 5*a*, 5*b*, the flanges of the bobbin 10 are provided with windows 10*h* through which the adjustment means is accessible.

In the further embodiment of the invention shown in FIG. 8, a permanent magnet 1 is located between two ferromagnetic pole shoes 4*a*, 4*c* acting as fixed contacts and forming normally-closed contact pairs with the free ends of the contact reeds 3*a*, 3*b*. This embodiment is chiefly suitable for monostable relays, particularly since the permanent magnetic circuit including the other pole shoes 4*b*, 4*d* which also serve as fixed contacts is substantially weaker than the magnetic circuit including the pole shoes 4*a*, 4*c*. Again in this embodiment, an opening of one contact pair accelerates the opening of the other contact pair when the switching condition of the relay is changed by the electromagnetic circuit.

We claim:

1. A polarized reed relay comprising (a) a bobbin having at least one coil wound thereon, (b) two ferromagnetic contact reeds extending substantially along the coil axis through an interior passage provided in the bobbin, each reed being fixed at one of its ends to the bobbin, (c) at least one permanent magnet, and (d) two pairs of pole shoes positioned in the bobbin, each pole shoe having a first portion disposed in proximity to a pole of the magnet and a second portion forming a fixed contact, each pair of fixed contacts cooperating with the free end of one of the reeds to form a double-throw contact system.

2. The relay of claim 1, wherein the reeds extend parallel to each other and are commonly adjustable.

3. The relay of claim 2, wherein the two reeds are positioned relatively to each other, and interconnected, by a piece of insulating material to form a unit.

4. The relay of claim 1, wherein either two of the pole shoes are positioned relatively to each other, and interconnected, by a piece of insulating material to form a unit.

5. The relay of claim 1, wherein the pole shoes and/or the reeds are connected to terminals positioned in slots provided in the bobbin.

6. The relay of claim 1, wherein the fixed contacts outside their contact areas abut against a spacer defining a contact air gap.

7. The relay of claim 6, wherein the bobbin is composed of two bobbin halves, the spacer consisting of a plate of insulating material disposed between said bobbin halves.

8. The relay of claim 1, including two coils, one associated with each double-throw contact system, whereby the two contact systems may be actuated independently.

9. The relay of claim 1, wherein said at least one permanent magnet, said pole shoes and fixed contacts are disposed at an intermediate location of the relay, and wherein the two contact reeds have their fixed ends adjustably connected to reed terminals mounted at opposite ends of the bobbin.

10. The relay of claim 8, wherein said two coils are electrically interconnected.

11. The relay of claim 1, including a capacitor and an integrated circuit electrically connected to terminals of said coil for ensuring synchronous actuation of both contact reeds.

12. The relay of claim 8, including means for independently adjusting each contact reed for monostable or bistable operation.

13. The relay of claim 1, including an insulating base and a ferromagnetic cap for enclosing the relay, the base having a shoulder for positioning said cap and an opening for introducing a casting material which tightly locks said cap to said base.

14. The relay of claim 1, having pole shoes formed as fixed contacts and a permanent magnet disposed at either end of the bobbin.

15. The relay of claim 14, wherein one permanent magnet has its South pole coupled to one of the pole shoes and the other permanent magnet has its North pole coupled to another one of the pole shoes, the two said pole shoes forming normally-closed contact pairs with the respective contact reeds.

16. The relay of claim 15, wherein the bobbin is provided with windows in the area of the mounting of the contact reeds to allow adjustment of the contact reeds at their connection to the reed terminals.

17. The relay of claim 1, wherein one permanent magnet is disposed between two of the pole shoes which form normally-closed contacts with the respective reeds.

* * * * *